United States Patent [19]

Ueda et al.

[11] Patent Number: 4,675,274

[45] Date of Patent: Jun. 23, 1987

[54] METHOD FOR DEVELOPING COLOR REVERSAL PHOTOGRAPHIC MATERIALS

[75] Inventors: Shinji Ueda; Junya Nakajima, both of Kanagawa, Japan

[73] Assignee: Fuji Photo Film Co., Ltd., Kanagawa, Japan

[21] Appl. No.: 756,620

[22] Filed: Jul. 19, 1985

[30] Foreign Application Priority Data

Jul. 19, 1984 [JP] Japan ..... 59-150264

[51] Int. Cl.[4] ..... G03C 5/50; G03C 5/30

[52] U.S. Cl. ..... 430/407; 430/379

[58] Field of Search ..... 430/379, 407

[56] References Cited

U.S. PATENT DOCUMENTS

| | | | |
|---|---|---|---|
| 3,212,892 | 10/1965 | von Konig et al. | 430/456 |
| 3,623,872 | 11/1971 | Berthold et al. | 430/963 |
| 4,371,610 | 2/1983 | Toyoda et al. | 430/445 |
| 4,525,449 | 6/1985 | Nakajima et al. | 430/407 |
| 4,554,245 | 11/1985 | Hayashi et al. | 430/505 |

FOREIGN PATENT DOCUMENTS 102639 9/1976 Japan .

*Primary Examiner*—John E. Kittle
*Assistant Examiner*—Mukund J. Shah
*Attorney, Agent, or Firm*—Sughrue, Mion, Zinn, Macpeak & Seas

[57] ABSTRACT

A method for processing an imagewise exposed silver halide color reversal photographic material which comprises processing the color reversal photographic material with a black-and-white developer containing at least one compound represented by the following general formula (I-a) or (I-b):

(I-a)

(I-b)

wherein M represents a hydrogen atom, an alkali metal, or an ammonium ion; R represents a hydrogen atom, an unsubstituted or substituted alkyl group, a hydroxy group, $-SO_3M^1$, or $-COOM^1$; $R^1$ represents $-SO_3M^1$ or $-COOM^1$, wherein $M^1$ represents a hydrogen atom, an alkali metal, or an ammonium ion; and n represents an integer of 1 to 6; and wherein n is 2 to 6, each of said Rs may be the same or different.

16 Claims, 1 Drawing Figure

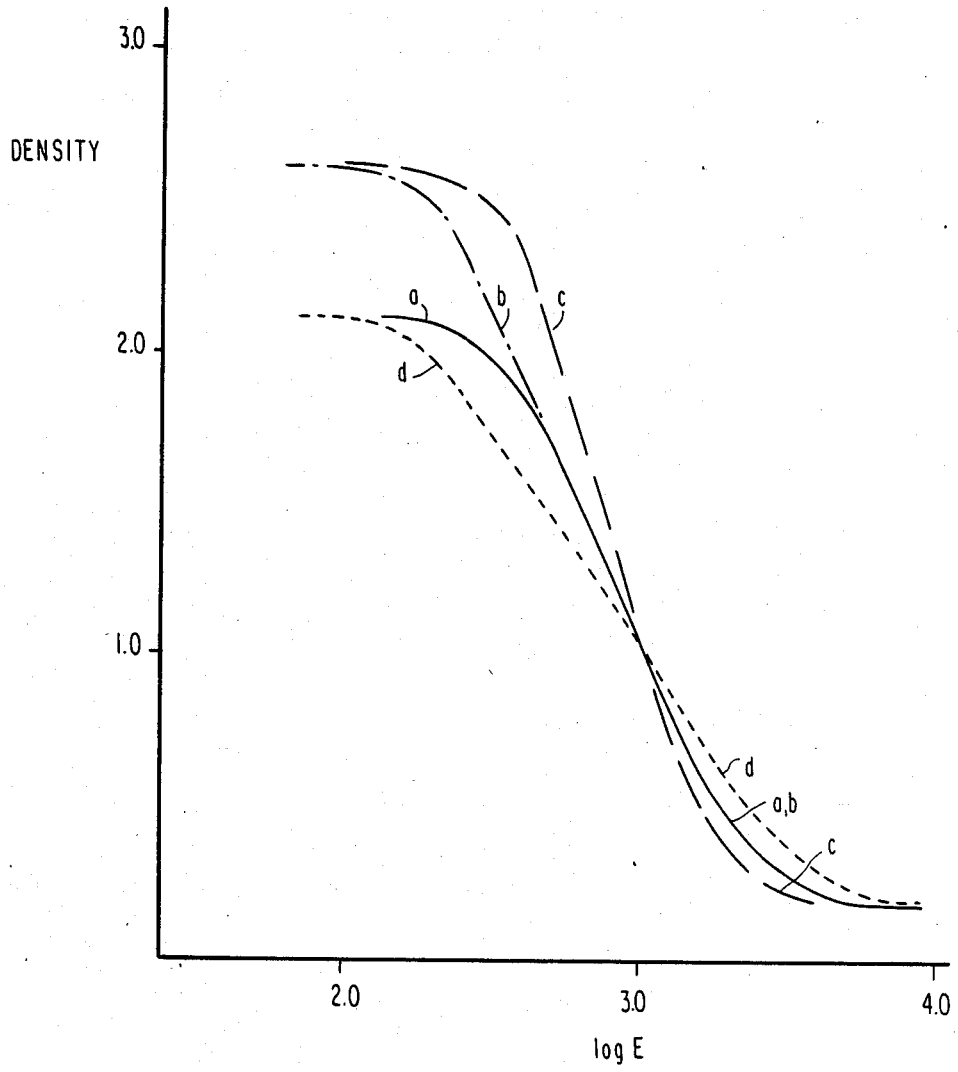
3.0
DENSITY
2.0
1.0
a
b
c
d
d
a,b
c
2.0
3.0
4.0
log E

METHOD FOR DEVELOPING COLOR REVERSAL PHOTOGRAPHIC MATERIALS

FIELD OF THE INVENTION

This invention relates to a method for developing silver halide color reversal photographic materials. More particularly, the invention relates to a black-and-white developing process for obtaining photographic images having high maximum density and well proportioned color balance with high sensitivity in a process of obtaining color photographic images by performing color reversal developing after black-and-white development. Furthermore, the invention relates to a sensitizing process for obtaining different sensitivities or a process for quickly obtaining images by changing the processing conditions.

BACKGROUND OF THE INVENTION

A silver halide color reversal photographic material has a narrow allowable light exposure range. Hence, in order to obtain good images using such a color photographic material, a very restricted suitable light exposure is required. That is, since the color images formed in the color reversal photographic material are viewed as final positive images, the gradation of the color photographic material is hard to select as compared with a color negative photographic material. Accordingly, it is required to use a color reversal photographic material having optimum sensitivity according to the purpose and the exposure conditions.

Also, for photographing specific scenes such as a sports photograph requiring a high shutter speed and a stage photograph lacking in the intensity of light for light exposure, a color photographic material having a high sensitivity is required but color reversal photographic materials having sufficient qualities for meeting the purpose of requiring the very high sensitivity as described above are few.

In such a circumstance, a high speed color reversal photographic material and sensitivity control by supplementing improper light exposure have strongly been desired.

For meeting these features, various development acceleration processes or sensitizing (or desensitizing) development processes have been proposed.

The process which has most generally been used is a process of prolonging the time for black-and-white development or a process of performing the development at a high temperature.

However, such a sensitizing (or desensitizing) process not always yields sufficient sensitizing processing aptitude to color reversal photographic materials.

That is, (1) the time for the first development must be greatly prolonged as compared to that for standard processing for attaining sufficient sensitivity using a color reversal photographic material, (2) in the case of a photographic material employing a construction having a high sensitive emulsion layer and a low sensitive emulsion layer, the gradation is changed by the sensitizing process since the development processing aptitude differs in both the layers, (3) the attempt of increasing the sensitivity by prolonging the time for the first development causes a great reduction in color image density, and (4) the color balance is deteriorated at the application of the sensitizing process due to the difference in development processing aptitudes among the red-sensitive emulsion layer, the green-sensitive emulsion layer, and the blue-sensitive emulsion layer.

Also, a process of using a development accelerator for obtaining high sensitivity is known. However, since as the development accelerators, cationic surface active agents, cationic dyes, neutral salts, polyalkylene oxides, organic amines, etc., described in L. F. A. Mason, *Photographic Processing Chemistry*, pages 41–44 (1966) (published by Focal Press, London & New York) are used, when these compounds are added to black-and-white developers, they show such strong tendencies that the development accelerating faculty becomes insufficient, the formation of fog is increased, and the maximum density of the reversal color images is lowered. Thus, the above described process is unsuitable for practical use.

For overcoming these difficulties, a process of using a black-and-white developer containing a thioether compound is proposed (Japanese Patent Application (OPI) No. 63530/82 (the term "OPI" as used herein refers to a "published unexamined Japanese patent application")). However, when the sensitizing degree is changed by changing the developing time or developing temperature in the foregoing process, the progress of development for a blue-sensitive emulsion layer, a green-sensitive emulsion layer, and a red-sensitive emulsion layer of a color reversal photographic material becomes irregular such that the color balance is lost.

For further overcoming the foregoing difficulty, there is proposed a process of using two balck-and-white developer baths (Japanese Patent Application (OPI) No. 81644/84). However, although a good performance can be obtained in the process, since the black-and-white development is composed of two steps in the process, the managements of processing liquids and processing conditions are complicated and very delicate, whereby it is difficult to maintain a constant photographic performance.

On the other hand, as an effective process for overcoming the above described difficulties in the sensitizing development, a process of restraining the formation of development fog in black-and-white development is known. For example, halogen compounds such as bromides, iodides, etc., are widely known for this purpose and are widely used for black-and-white developers. However, in the case of performing the sensitizing development, the fog restraining power by this process is insufficient and the desired purpose cannot be obtained.

Also, 1-phenyl-5-mercaptotetrazole, 4-phenyl-2-mercaptothiazole, 2-mercaptobenzoxazole, 2-mercaptobenzothiazole and 1,2-naphthyl-5-mercaptotetrazole described in U.S. Pat. No. 2,725,290 have an effect for preventing the upper emulsion layer(s) of a multilayer color photographic material from being excessively developed in the case of performing a high temperature black-and-white development process. However, since these compounds have a very high development restraining effect, the use of a small amount of the compound restrains the development of the upper emulsion layer(s). Accordingly, if a large amount of the compound is used for restraining the development or the formation of fog for the lower emulsion layer(s), the development for the upper emulsion layer(s) are excessively restrained such that the color balance is lost.

Furthermore, as compounds which have a weaker action than the foregoing development inhibitors (or anti-foggants), 5-methylbenzotriazole and 6-nitrobenzimidazole are known and described in the above described L. F. A. Mason, *Photographic Processing Chemistry*, pages 39–41 (1966). However, these compounds show a low antifogging effect for the lower emulsion layer(s) at black-and-white development and if a large amount of the compound is used, the compound shows a strong development inhibiting action for the lower emulsion layer(s) so as to reduce the sensitivity.

As described above, in the case of sensitizing processing or quick processing multilayer color reversal photographic materials, it is necessary to balance the antifogging effect for each emulsion layer at black-and-white development but it is very difficult to restrain the formation of fog at black-and-white development without reducing the sensitivity of the lowermost emulsion layer while reducing or removing the influence of the uppermost emulsion layer on the development.

Therefore, the development of a technique capable of solving the above described problems in conventional techniques and desirably controlling the extent of sensitization without showing any bad influences at standard processing has been desired.

SUMMARY OF THE INVENTION

A first object of this invention is to provide a developing process for color reversal photographic materials capable of obtaining photographic images having high sensitivity and high maximum density, in particular, high sensitivity and high maximum density for the red-sensitive emulsion layer and a good color balance.

A second object of this invention is to provide a developing process for color reversal photographic materials capable of obtaining photographic images being different and good sensitivities for the same photographic material by changing the development conditions.

A third object of this invention is to provide a quick developing process for color reversal photographic materials capable of obtaining good photographic images in a short period of time.

As a result of various investigations, the inventors have discovered that the above described objects of this invention can be attained by the process of this invention as set forth below.

That is, according to this invention, there is provided a process of processing an imagewise exposed silver halide color reversal photographic material, which comprises processing the photographic material by a black-and-white developer containing at least one compound represented by general formula (I-a) or (I-b):

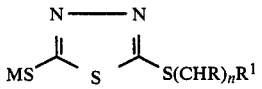

(I-a)

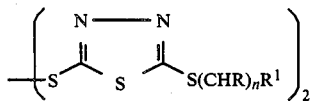

(I-b)

wherein M represents a hydrogen atom, an alkali metal, or an ammonium ion; R represents a hydrogen atom, a substituted or unsubstituted alkyl group (e.g., a methyl group, an ethyl group, a propyl group, a carboxymethyl group, etc., preferably having 1 to 6 carbon atoms), a hydroxy group, $-SO_3M^1$ or $-COOM^1$; $R^1$ represents $-SO_3M^1$ or $-COOM^1$ (wherein $M^1$ represents a hydrogen atom, an alkali metal or an ammonium ion); and n represents an integer of 1 to 6; and wherein n is 2 to 6, each of said Rs may be the same or different.

BRIEF DESCRIPTION OF THE DRAWING

The FIGURE is a graph showing characteristic curves a, b, c and d in the black-and-white development process of this invention and in the comparison examples.

DETAILED DESCRIPTION OF THE INVENTION

In the foregoing general formulae, M and $M^1$ are an alkali metal such as lithium, sodium, potassium, etc., preferably lithium, sodium and potassium.

Examples of the substituent for R are a sulfonic acid group, a carboxylic acid group, a hydroxy group, etc., preferably a sulfonic acid group and a carboxylic acid group.

As a result of various investigations, the inventors have discovered that the thiadiazole compounds shown by the above described general formula (I-a) or (I-b) meet the requirements described above.

Japanese Patent Application (OPI) No. 102639/76 discloses that the formation of development fog in the uppermost emulsion layer of a color photographic material can be prevented by color developing the photographic material in the presence of a thiadiazole compound. It is also described that in this case the thiadiazole compound may be carried into the color developing bath from a bath preceding the color development, such as a neutralization bath, a prehardening bath, a black-and-white developing bath, etc., but the gist of the foregoing invention is in the prevention of fog for the uppermost emulsion layer of a color photographic material at color development. Thus, the foregoing patent application discloses neither the prevention of fog at black-and-white development nor the technical idea of the present invention.

Furthermore, Japanese Patent Application (OPI) No. 26848/82 discloses that a thiadiazole compound prevents the occurrence of sludges in a black-and-white developer in the case of processing black-and-white photographic materials but there are neither a description nor suggestion about the technique and the effect of the present invention.

Under such circumstances, it has now been discovered that the specific thiadiazole compounds shown by general formula (I-a) or (I-b) show a new effect in a manner different from the conventional manners as described above.

That is, the above described thiadiazole compounds of this invention can restrain the formation of fog in the black-and-white development of color reversal photographic materials almost without giving adverse influences on the development of the uppermost emulsion layer of the photographic material and without reducing the sensitivity of the lower emulsion layer(s).

Now, the "lower layer(s)" in this specification means silver halide emulsion layer(s) disposed under the uppermost silver halide emulsion layer in a multilayer color reversal photographic material.

For example, in the case of a color reversal photographic material having a layer structure of a red-sensitive emulsion layer, a green-sensitive emulsion layer and a blue-sensitive emulsion layer disposed on a support in this order, the lower emulsion layers or lower layers mean the red-sensitive emulsion layer and the green-sensitive emulsion layer. In this case, the effect of this invention is particularly remarkable in the red-sensitive emulsion layer.

Specific nonlimiting examples of the compounds shown by general formula (I-a) or (I-b) described above are illustrated below.

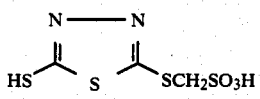
(I-a-1)

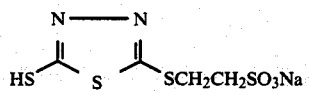
(I-a-2)

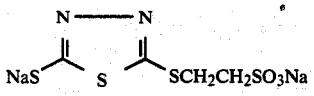
(I-a-3)

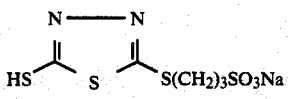
(I-a-4)

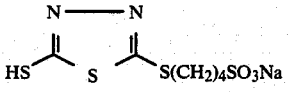
(I-a-5)

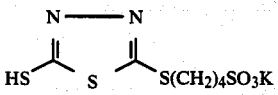
(I-a-6)

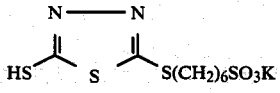
(I-a-7)

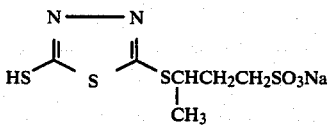
(I-a-8)

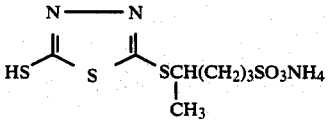
(I-a-9)

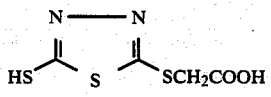
(I-a-10)

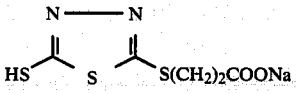
(I-a-11)

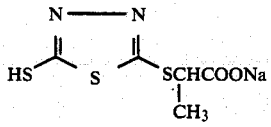
(I-a-12)

-continued

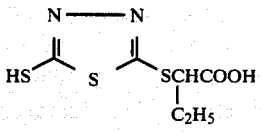
(I-a-13)

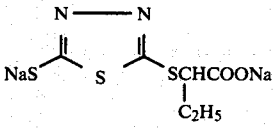
(I-a-14)

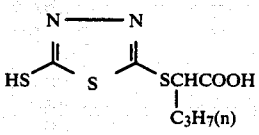
(I-a-15)

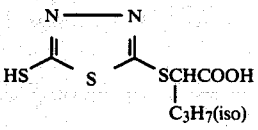
(I-a-16)

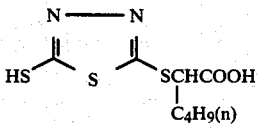
(I-a-17)

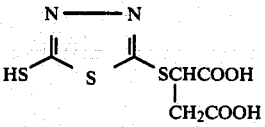
(I-a-18)

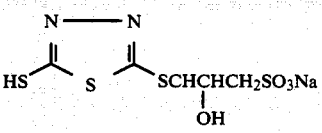
(I-a-19)

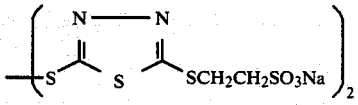
(I-b-1)

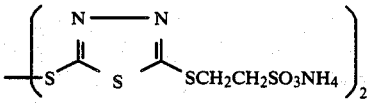
(I-b-2)

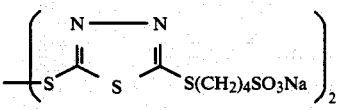
(I-b-3)

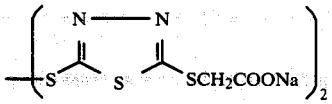
(I-b-4)

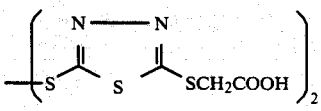
(I-b-5)

-continued (I-b-6)

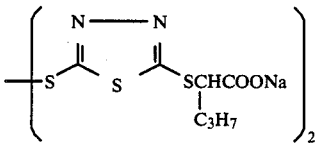

(I-b-7)

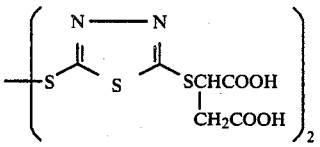

The compounds for use in this invention shown by general formula (I-a) or (I-b) described above are known compounds and they can be easily prepared by the methods described in, for example, Japanese Patent Application (OPI) Nos. 102639/76, 28426/78, 16734/82, 26848/82 and Japanese Patent Publication No. 35494/73.

In the case of using the compounds shown by general formula (I-a) or (I-b) in a black-and-white developer, etc., the content of the compound is preferably $5\times10^{-7}$ mol to $5\times10^{-2}$ mol, more preferably $1\times10^{-6}$ mol to $2\times10^{-3}$ mol, particularly preferably $1\times10^{-6}$ mol to $1\times10^{-4}$ mol, per liter of the processing liquid.

The silver halide photographic materials for use in this invention are silver halide color reversal photographic materials such as reversal color photographic films and reversal color photographic papers, as is described in James, Ed., *The Theory of the Photographic Process,* 4th Ed. (1977), page 336.

For the photographic processing in this invention, known color image forming processes as described in, for example, *Research Disclosure,* Vol. 176, pages 28 to 30 can be used.

The processing temperature is preferably selected in the range of 18° C. to 60° C., more preferably 25° C. to 42° C. The processing time is preferably about 1 to 15 minutes, more preferably 2 to 12 minutes, in the case of black-and-white development and preferably about 1 to 10 minutes, more preferably 2 to 6 minutes, in the case of color development.

In a preferred embodiment of processing process of this invention for color reversal photographic materials, the steps of black-and-white development (first development)→stop→wash→reversal→color development→stop→wash→control bath→wash→bleach→wash→fix→wash→stabilization→drying are usually used. In the processing step, a prebath, a prehardening bath, a neutralization bath, etc., may be further employed. Also, the wash step after the stop, the color development, the control bath or the fix may be, as the case may be, omitted. The reversal may be performed by using a fogging bath or by a re-exposure. Also, the reversal may be omitted by adding a fogging agent to the color developing bath. Furthermore, the control bath may be, as the case may be, omitted.

For the black-and-white developer for use in this invention, a known developing agent can be used. As the developing agent, there are dihydroxybenzenes (e.g., hydroquinone, etc.), 3-pyrazolidones (e.g., 1-phenyl-3-pyrazolidone, etc.), aminophenols (e.g., N-methyl-p-aminophenol, etc.), 1-phenyl-3-pyrazolines, ascorbic acid, and the heterocyclic compounds formed by the condensations of 1,2,3,4-tetrahydroquinoline rings and indolene rings as described in U.S. Pat. No. 4,067,872. These compounds can be used individually or as a combination of them.

The black-and-white developers for use in this invention may further contain, if necessary, preservatives (e.g., sulfites, hydrogensulfites, etc.), buffers (e.g., carbonates, boric acid, borates, alkanolamines, etc.), alkali agents (e.g., hydroxides, carbonates, etc.), dissolution aids (e.g., polyethylene glycols, the esters thereof, etc.), pH adjusting agents (e.g., organic acids such as acetic acid), sensitizers (e.g., quaternary ammonium salts, etc.), development accelerators, surface active agents, defoaming agents, hardening agents, tackifiers, etc.

It is necessary that the black-and-white developer for use in this invention contains a compound functioning as a silver halide solvent but usually a sulfite which is added to the developer as a preservative as described above functions as the silver halide solvent. Specific examples of the sulfite and other compounds which can be used as the silver halide solvent in this invention are KSCN, NaSCN, $K_2SO_3$, $Na_2SO_3$, $K_2S_2O_5$, $Na_2S_2O_5$, $K_2S_2O_3$, $Na_2S_2O_3$, etc.

Also, a development accelerator is used for the black-and-white developer for imparting a development accelerating action to the developer and as the development accelerator, compounds shown by the following general formula (II) described in Japanese Patent Application (OPI) No. 63580/82 can be preferably used individually or as a combination thereof or a combination thereof and the above described silver halide solvent.

$$R_2—S—R_1)_dS—R_2 \qquad \text{(II)}$$

wherein $R_1$ represents an alkylene group having 2 to 10 carbon atoms, said alkylene group may have an ether bond; $R_2$ represents a substituted or unsubstituted alkyl group having 2 to 10 carbon atoms, said alkyl group may have an ether bond or an ester bond; and d represents an integer of 0 to 3.

If the amount of the silver halide solvent is too small, the progress of the development is delayed and if the amount is too much, it causes the formation of fog in the silver halide emulsion layers. Thus, there exists a preferred range of the amounts thereof, which can be easily determined by a person skilled in the art.

For example, the content of $SCN^-$ is preferably 0.005 to 0.02 mol, more preferably 0.01 to 0.015 mol, per liter of the developer, the content of $SO_3^{--}$ is preferably 0.05 to 1 mol, more preferably 0.1 to 0.5 mol, per liter of the developer, the content of $S_2O_5^{--}$ is preferably 0.02 to 0.5, mol, more preferably 0.05 to 0.3 mol, per liter of the developer, and the content of $S_2O_3^{--}$ is preferably 0.01 to 1 mol, more perferably 0.05 to 0.5 mol, per liter of the developer.

In the case of adding the compound of general formula (II) to the black-and-white developer in this invention, the content thereof is preferably $5\times10^{-6}$ to $5\times10^{-1}$ mol, more preferably $1\times10^{-4}$ to $2\times10^{-1}$ mol, per mol of the developer.

Furthermore, the black-and-white developer may contain, together with the compound of general formula (I-a) or (I-b) for use in this invention, a known anti-foggant (e.g., a halide such as potassium bromide, potassium iodide, etc., benzimidazoles, benzotriazoles, benzothiazoles, tetrazoles, thiazoles, etc.). The halide as antifoggant is preferably used in an amount of $1\times10^{-4}$ to 20 g per liter of the developer and the organic antifoggant is preferably used in an amount of $1\times10^{-4}$ to 5 g per liter of the developer.

Furthermore, the black-and-white developer for use in this invention may contain a swelling preventing agent (e.g., an inorganic salt such as sodium sulfate, etc.), a water softener (e.g., polyphosphonic acids, aminopolycarboxylic acids, phosphonic acids, aminophosphonic acids, etc., and the salts thereof), etc.

The pH value of the black-and-white developer thus prepared is selected to an extent sufficient for giving the desired density and contrast and is usually selected in the range of about 8.5 to 11.5, preferably 9 to 11.

For peforming sensitizing processing using the first developer, the developing time may be prolonged to at most about thrice that of standard processing. In this case, by increasing the processing temperature, the prolonged time for the sensitizing processing can be shortened.

The fogging bath for use in this invention may contain a known fogging agent. Examples of the fogging agent are stannous ion-organic phosphoric acid complex salts (as described in U.S. Pat. No. 3,617,282), stannous ion-organic phosphonocarboxylic acid complex salts (as described in Japanese Patent Publication No. 32616/81), stannous ion-aminopolycarboxylic acid complex salts (as described in British Pat. No. 1,209,050), etc.; and boron compounds such as boron hydride compounds (as described in U.S. Pat. No. 2,984,567), heterocyclic amine-boran compounds (as described in British Pat. No. 1,011,000). The pH of the fogging bath (reversal bath) is selected in a wide range from acid side to alkaline side and is preferably 2 to 12, more preferably 2.5 to 10, most preferably 3 to 9.

The color developer for use in this invention has the composition for a general color developer containing an aromatic primary amino developing agent. Specific examples of the aromatic primary amino color developing agent are p-phenylenediamine derivatives such as N,N-diethyl-p-phenylenediamine, 2-amino-5-diethylaminotoluene, 2-amino-5-(N-ethyl-N-laurylamino)-toluene, 4-[N-ethyl-N-(β-hydroxyethyl)amino]aniline, 2-methyl-4-[N-ethyl-N-(β-hydroxyethyl)amino]aniline, N-ethyl-N-(β-methanesulfonamidoethyl)-3-methyl-4-aminoaniline, N-(2-amino-5-diethylaminophenylethyl)-methanesulfonamide, N,N-dimethyl-p-phenylenediamine, etc. Furthermore, 4-amino-3-methyl-N-ethyl-N-methoxyethylaniline, 4-amino-3-methyl-N-ethyl-N-β-ethoxyethylaniline, 4-amino-3-methyl-N-ethyl-N-β-butoxyethylaniline and the salts thereof (e.g., sulfates, hydrochlorides, sulfites, p-toluenesulfonates, etc.), etc., described in U.S. Pat. Nos. 3,656,950, 3,698,525, etc., are preferably used as the color developing agent.

The color developer can further contain other known alkali agents or buffers such as sodium hydroxide, potassium hydroxide, sodium carbonate, potassium carbonate, sodium phosphate, potassium phosphate, potassium metaborate, borax, etc., individually or as a combination of them.

The color developer may further contain ordinary preservatives such as sulfites (e.g., sodium sulfite, potassium sulfite, potassium hydrogensulfite, sodium hydrogensulfite, etc.), and hydroxylamine, etc.

Furthermore, the color developer may, if necessary, contain a developing accelerator. Examples of the developing accelerator are the various pyridinium compounds and other cationic compounds described in, for example, U.S. Pat. No. 2,648,604, Japanese Patent Publication No. 9503/69, U.S. Pat. No. 3,671,247, etc.; cationic dyes such as phenosafranine, etc.; neutral salts such as thallium nitrate, potassium nitrate, etc.; nonionic compounds such as polyethylene glycol and the derivatives thereof, the polythioethers, etc., described in Japanese Patent Publication No. 9504/69, U.S. Pat. Nos. 2,533,990, 2,531,832, 2,950,970, 2,577,127, etc.; the organic solvent and the organic amines described in Japanese Patent Publication No. 9509/69, Belgian Pat. No. 682,862, etc.; ethanolamine, ethylenediamine, diethanolamine, etc.; as well as the accelerators described in L. F. A. Mason, *Photographic Processing Chemistry,* pages 40–43 (published by Focal Press, London, 1966).

Moreover, the color developer may further contain aminopolycarboxylic acid such as ethylenediaminetetraacetic acid, nitrilotriacetic acid, cyclohexanediaminetetraacetic acid, iminodiacetic acid, N-hydroxymethylethylenediaminetetraacetic acid, diethylenetriaminepentaacetic acid, etc., as a water softener.

The color developer may further contain, if necessary, a competing coupler and a compensating developer.

Examples of the competing coupler are citrazinic acid, J-acid, H-acid, etc. Examples of the compensating developer are p-aminophenol, N-benzyl-p-aminophenol, 1-phenyl-3-pyrazolidone, etc.

The pH of the color developer is preferably in the range of about 8 to 13, more preferably 9.5 to 12.5. The temperature of the color developer is selected in the range of 20° C. to 70° C. and is preferably 30° C. to 60° C.

The photographic emulsion layers are usually bleached after color development. The bleach process may be performed simultaneous with or separately from a fix process. As the bleaching agent for the bleach solution, there are compounds of polyvalent metals such as iron (III), cobalt (IV), chromium (VI), copper (II), etc.; peracids; quinones; nitron compounds, etc. Specific examples of the bleaching agent are ferricyanides, dichromates, organic complex salts of iron (III) or cobalt (III); aminopolycarboxylic acids such as ethylenediaminetetraacetic acid, nitrilotriacetic acid, 1,3-diamino-2-propanoltetraacetic acid, etc.; the complex salts of organic acids such as citric acid, tartaric acid, malic acid, etc.; persulfates, permanganates; nitrosophenol, etc. In these compounds, potassium ferricyanide, ethylenediaminetetraacetic acid iron (III) sodium, and ethylenediaminetetraacetic acid iron (III) ammonium are particularly useful. The aminopolycarboxylic acid iron (III) complex salt is useful for a bleach solution or a blix solution, The bleach solution or blix solution, or a prebath thereof (e.g., controlling solution) may further contain the bleach accelerators and various additives described in U.S. Pat. Nos. 3,042,520, 3,241,966, Japanese Patent Publication Nos. 8506/70, 8836/70, Japanese Patent Application (OPI) No. 95630/78, etc.

As a fix bath for use in this invention, ammonium thiosulfate, sodium thiosulfate, potassium thiosulfate, etc., can be used as the fixing agent in an amount of about 30 g/liter to 200 g/liter. The fix solution may further contain a stabilizer such as a sulfite, a metabisulfite, etc.; a hardening agent such as potassium alum, etc.; and a pH buffer such as an acetate, a borate, a phosphate, a carbonate, etc. The pH of the fix solution is 3 to 10, preferably 5 to 9.

The processing process of this invention can be applied to a color photographic process for processing color photographic materials containing therein dye forming couplers as described in U.S. Pat. Nos. 2,322,027, 2,376,679, 2,801,171, etc., as well as a color photographic process wherein coloring agents are present in color developers as described in, for example, U.S. Pat. Nos. 2,252,718, 2,590,970, 2,592,243, etc.

However, at present the former color photographic process is mainly performed. When dye forming couplers are present in color photographic materials, a multilayer color photographic material is generally used and in this case, it is preferred that these couplers do not diffuse into other layers during the production steps for the color photographic material, or during the preservation and processing steps of the color photographic material.

The photosensitive silver halide for use in this invention may be silver bromide, silver iodide, silver iodobromide, silver chlorobromide, silver chloroiodobromide, silver chloride, etc., capable of forming a latent image by imagewise exposure.

There is no particular restriction on the mean grain size (shown by the diameter of the grain in the case of spherical grains or grains similar to spherical grains, or shown by the mean value based on the projected areas using the long side as the grain size in the case of cubic grains) of the silver halide grains in the silver halide photographic emulsions for use in this invention but silver halide grains having a mean grain size of 3 $\mu$ or less are preferred. The distribution of the grain sizes may be narrow or broad.

The silver halide grains in the photographic emulsions may have a regular crystal form such as a cube or an octahedron, an irregular crystal form such as a spherical form, a tabular form, etc., or a composite form of these crystal forms. The silver halide grains may be composed of a mixture of silver halide grains having various crystal forms.

Furthermore, the above described photographic emulsion may be a mixture of a silver halide emulsion having no fogged nuclei in the inside of the grains and a silver halide emulsion having fogged nuclei in the inside of the grains. The preparation method for the silver halide emulsion having no fogged nuclei in the inside of the grains described above and the mixing ratio of both silver halide emulsions are described in Japanese Patent Application No. 88939/83.

These photographic emulsions can be prepared by the methods described in, for example, P. Glafkides, *Chimie et Physique Photographique* (published by Paul Montel, 1967), G. F. Duffin, *Photographic Emulsion Chemistry* (published by The Focal Press, 1966), V. L. Zelikman et al., *Making and Coating Photographic Emulsion* (The Focal Press, 1964), etc. That is, they may be prepared by using an acid method, a neutralization method, an ammonia method, etc. Also, as a system for reacting a soluble silver salt and a soluble halide, a one side mixing method, a simultaneously mixing method, or a combination of them can be used.

A so-called reverse mixing method for forming silver halide in the presence of excessive silver ion can be also used. As one system for the simultaneously mixing method, a so-called controlled double jet method for maintaining the pAg in the liquid phase wherein silver halide is formed at a constant value can be also used. According to the method, a silver halide emulsion wherein the crystal form of the silver halide grains is regular and the grain sizes are almost uniform can be obtained.

A mixture of two or more kinds of silver halide emulsions separately formed can be used in this invention.

The silver halide grains may be formed or physically ripened in the presence of a cadmium salt, a zinc salt, a lead salt, a thallium salt, an iridium salt or a complex salt thereof, a rhodium salt or a complex salt thereof, an iron salt or a complex salt thereof, etc.

The silver halide emulsion can be used as a primitive emulsion without applying thereto a chemical sensitization but is usually chemically sensitized. For the chemical sensitization, the methods described in, for example, P. Glafkides, *Chimie et Physique Photographique* (published by Paul Montel, 1966), V. L. Zelikman et al., *Making and Coating Photographic Emulsion* (published by the Focal Press, 1964), H. Frieser, *Die Grundlagen der Photographischen Prozesse mit Silberhalogeniden* (published by Akademische Verlagsgesellschaft, 1968), etc., can be used.

That is, a sulfur sensitization method using a sulfur-containing compound capable of reacting with the silver ion and active gelatin; a reduction sensitization method using a reducing agent; and a noble metal sensitization method can be used individually or as a combination of them.

As the sulfur sensitizer, there are thiosulfates, thioureas, thiazoles, rhodanines, etc. As the reduction sensitizers, there are stannous salts, amines, hydrazine derivatives, formamidinesulfinic acid, silane compounds, etc. Also, as the noble metal sensitizer, there are gold complex salts and complex salts of a metal belonging to Group VIII of the Periodic Table, such as platinum, iridium, palladium, etc.

Each silver halide photographic emulsion layer of a color photographic material to be processed by the development process of this invention contains a dye forming coupler, i.e., a compound capable of coloring by the oxidative coupling with an aromatic primary amine developing agent (e.g., a phenylenediamine derivative, an aminophenol derivative, etc.) in the color developing process. For example, as a magenta coupler which is used for a green-sensitive silver halide emulsion layer, there are a 5-pyrazoline coupler, a pyrazolobenzimidazole coupler, a cyanoacetylcumarone coupler, an open chain acylacetonitrile coupler, etc.; as a yellow coupler which is used for a blue-sensitive silver halide emulsion layer, there are an acylacetamide coupler (e.g., a benzoylacetanilide, a pivaloylacetanilide, etc.), etc.; and as a cyan coupler which is used for a red-sensitive silver halide emulsion layer, there are a naphthol coupler, a phenol coupler, etc.

It is preferred that the coupler is a non-diffusible coupler having a hydrophilic group called as a ballast group in the molecule. Also, the coupler may be of 4-equivalent or 2-equivalent for the silver ion.

The photographic silver halide emulsions for use in this invention may be spectrally sensitized by methine dyes, etc. Dyes used for this purpose include cyanine dyes, merocyanine dyes, complex cyanine dyes, complex merocyanine dyes, holopolar cyanine dyes, hemicyanine dyes, styryl dyes, and hemioxonol dyes. Particularly advantageous dyes are cyanine dyes, merocyanine dyes, and complex merocyanine dyes. For these dyes can be applied any nuclei which are usually utilized for cyanine dyes as basic heterocyclic nuclei.

That is, pyrroline nuclei, oxazoline nuclei, thiazoline nuclei, pyrrole nuclei, oxazole nuclei, thiazole nuclei, selenazole nuclei, imidazole nuclei, tetrazole nuclei, pyridine nuclei, etc.; the nuclei formed by fusing an alicyclic hydrocarbon ring to these nuclei; and the nuclei formed by fusing an aromatic hydrocarbon ring to these nuclei, such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei, quinoline nuclei, etc., can be applied. These nuclei may be substituted on a carbon atom.

For merocyanine dyes or complex merocyanine dyes, 5-membered or 6-membered heterocyclic nuclei such as pyrazoline-5-one nuclei, thiohydantoin nuclei, 2-thiooxazolidine-2,4-dione nuclei, thiazolidine-2,4-dione nuclei, rhodanine nuclei, thiobarbituric acid nuclei, etc., can be applied.

In these dyes, the sensitizing dyes each having at least two water solubilizing groups are particularly useful, such dyes are described in Japanese Patent Application No. 10091/83.

These sensitizing dyes may be used individually or may be used as a combination of them. The combination of sensitizing dyes is frequently used for the purpose of supersensitization.

Furthermore, a color reversal photographic material for which the developing process of this invention is applied may contain in the photographic emulsion layers a dye having no spectral sensitizing action by itself or a material which does not substantially absorb visible light and shows supersensitization.

The light-sensitive emulsion layers for use in this invention each may be composed of two or more layers. In this case, an emulsion layer having a higher sensitivity is preferably disposed on the layer having the same color sensitivity and a lower sensitivity.

As the binder for the light-sensitive photographic silver halide emulsion layers, interlayers and other layers of the color photographic materials which are processed by the developing process of this invention, gelatin is advantageously used but other hydrophilic colloids may be used. For example, gelatin derivatives; graft polymers of gelatin and other high molecular materials; proteins such as albumin, casein, etc.; cellulose derivatives such as hydroxyethyl cellulose, carboxymethyl cellulose, cellulose sulfuric acid ester, etc.; sugar derivatives such as sodium alginate, starch derivatives, etc.; and various synthetic hydrophilic polymers such as polyvinyl alcohol, polyvinyl alcohol partial acetal, poly-N-vinylpyrrolidone, polyacrylic acid, polymethacrylic acid, polyacrylamide, polyvinyl imidazole, polyvinyl pyrazole, etc.

Gelatin for use in the above described color photographic materials includes limed gelatin as well as acid-treated gelatin and enzyme-treated gelatin as described in *Bull. Soc. Sci. Phot. Japan,* No. 16, 30 (1966).

The color photographic materials which are processed in this invention may further contain polyethylene oxide or derivatives thereof such as ethers, esters, amines, etc., thioether compounds, thiomorpholines, quaternary ammonium salt compounds, urethane derivatives, urea derivatives, imidazole derivatives, 3-pyrazolidones, etc., for the purpose of development acceleration.

The color phototgraphic materials which are processed in this invention can further contain various known antifoggants or stabilizers such as, for example, azoles such as benzothiazolium salts, nitroindazoles, triazoles, benzotriazoles, benzimidazoles (in particular, the nitro- or halogen-substituted products thereof), etc.; heterocyclic mercapto compounds such as mercaptothiazoles, mercaptobenzothiazoles, mercaptobenzimidazoles, mercaptothiadiazoles, mercaptotetrazoles (in particular, 1-phenyl-5-mercaptotetrazole, etc.), mercaptopyridines, etc.; the foregoing heterocyclic mercapto compounds having a water solubilizing group such as a carboxy group and a sulfon group; thioketo compounds such as oxazolinethione, etc.; azaindenes such as tetraazaindenes (in particular, 4-hydroxy-substituted (1,3,3a,7) tetraazaindenes, etc.); benzenethiosulfonic acid; benzenesulfonic acid, etc.

The color photographic materials which are processed in this invention may further contain in the silver halide photographic emulsion layers and other photographic layers inorganic or organic hardening agents. As such hardening agents, there are, for example, chromium salts (e.g., chrome alum, chromium acetate, etc.), aldehydes (e.g., formaldehyde, glyoxal, glutaraldehyde, etc.), N-methylol compounds (e.g., dimethylolurea, methyloldimethyl hydantoin, etc.), dioxane derivatives (e.g., 2,3-dihydroxydioxane, etc.), active vinyl compounds (e.g., 1,3,5-triacryloyl-hexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.), etc. They can be used individually or as a combination of them.

The silver halide photographic emulsion layers and other layers of the color photographic materials which are processed in this invention may contain various surface active agents for various purposes such as for coating aids, for static prevention, for improving sliding property, for improving dispersibility, for preventing adhesion, and for improving photographic characteristics (e.g., the acceleration of development, the increase of contrast, the sensitization, etc.).

Examples of the surface active agents are nonionic surface active agents such as saponin (steroid series), alkylene oxide derivatives (e.g., polyethylene glycol, a polyethylene glycol/polypropylene glycol condensation product, polyethylene glycol alkyl ethers, polyethylene glycol alkylaryl ethers, polyethylene glycol esters, polyethylene glycol sorbitan esters, polyalkylene glycol alkylamines, polyalkylene glycol alkylamides, polyethylene oxide addition products of silicone, etc.), glycidol derivatives (e.g., alkenylsuccinic acid polyglyceride, alkylphenol polyglyceride, etc.), fatty acid esters of polyhydric alcohols, alkylesters of sugar, etc.; anionic surface active agents having an acid group such as a carboxy group, a sulfo group, a phospho group, a sulfuric acid ester group, a phosphoric acid ester group, etc., for example, alkylcarboxylate, alkylsulfonates, alkylbenzenesulfonates, alkylnaphthalenesulfonates, alkylsulfuric acid esters, alkylphosphoric acid esters, N-acyl-N-alkyltaurines, sulfosuccinic acid esters, sulfoalkyl polyoxyethylene alkylphenyl ethers, polyoxyethylene alkylphosphoric acid esters, etc.; amphoteric surface active agents such as amino acids, aminoalkylsulfonic acids, aminoalkylsulfuric acid ester, aminoalkylphosphoric acid ester, alkylbetaines, amine oxides, etc.; and cationic surface active agents such as alkylamines salts, aliphatic or aromatic quaternary ammonium salts, heterocyclic quaternary ammonium salts (e.g., pyridinium, imidazolium, etc.), phosphonium or sulfonium salts having an aliphatic or heterocyclic ring, etc.

The color photographic material which is processed by the process of this invention may further contain a developing agent such as those described in *Research Disclosure,* "Developing Agents", Vol. 176, page 29.

The color photographic materials which are processed in this invention may further contain in the photographic emulsion layers and other photographic layers various dyes as filter dyes or for irradiation prevention or other various purposes. Such dyes for use in this invention are described in *Research Disclosure,* "Absorbing and Filters Dyes", Vol. 176, pages 25 and 26.

The photographic materials which are processed in this invention can contain antistatic agents, plasticizers, matting agents, lubricants, ultraviolet absorbents, optical whitening agents, air fogging preventing agents, etc.

For producing color photographic materials which are processed in this invention, silver halide emulsion layers and/or other layers are coated on a support. For coating these layers, the methods described in *Research Disclosure,* "Coating Procedures", Vol. 176, pages 27 and 28 can be used.

According to the process of this invention, various preferred characteristics as shown below which have not been attained by the known processes can be obtained.

First, when the developing process of this invention is performed under the conditions for obtaining a high sensitivity, color photographic images having high maximum density and good color balance can be obtained.

That is, when the speed of the development is increased by increasing the temperature for black-and-white development, prolonging the time for the black-and-white development, or using a development accelerator for obtaining a high sensitivity, the occurrence of development fog in the lowermost layer (red-sensitive emulsion layer) is serious, which results in reducing the maximum density of the cyan color images of the final color images and makes the color balance strongly reddish so as to greatly reduce the quality of the color images by a conventional process. However, according to this invention, the developing process can be performed without being accompanied by such difficulties and the above described first object can be attained.

Second, by changing the processing conditions using a processing solution of a constant composition, good photographic images each having a different sensitivity can be obtained using the same kind of color photographic materials. That is, by changing the temperature and time for a conventional black-and-white development or the strength of stirring, the sensitivity can be changed using the same kind of color photographic materials in this invention. According to the process of this invention, the development for each of the blue-sensitive emulsion layer, the green-sensitive emulsion layer and the red-sensitive emulsion layer can progress in a similar state to each other, whereby a good color balance is obtained even at different sensitivities to give color images having sufficiently preferred quality.

Third, when the developing process is performed quickly in a short period of time using a conventionally known development accelerating method, color images having good color balance can be obtained at high sensitivity. That is, when various conventional black-and-white development accelerating methods are employed for the purpose of quick processing, a sufficient development accelerating effect is obtained but at the same time, the maximum density of the color images thus formed is reduced and the color balance thereof is lowered. On the other hand, according to this invention, color images of good quality can be obtained in a short period of time without being accompanied by the foregoing difficulties.

The following examples are intended to illustrate this invention in more detail but not to limit it in any way.

EXAMPLE 1

A color reversal photographic material was prepared by coating, in succession, the following first to twelfth layers on a triacetate film base.

First Layer

Antihalation Layer (gelatin layer containing black colloid silver)

Second Layer

Gelatin Interlayer

The layer was formed by dissolving 2,5-di-t-octylhydroquinone in a mixture of 100 ml of dibutyl phthalate and 100 ml of ethyl acetate, mixing the solution with 1 kg of an aqueous solution of 10% gelatin with stirring at high speed, mixing 2 kg of the emulsion thus formed with 1.5 kg of an aqueous 10% gelatin solution together with 1 kg of a fine grain silver halide emulsion (grain size: 0.06μ, 1 mol% silver iodobromide emulsion) which was not chemically sensitized, and coating the mixture at a dry thickness of 2μ (silver coverage of 0.4 g/m$^2$).

Third Layer

Low Speed Red-Sensitive Emulsion Layer

The layer was formed by dissolving 100 g of a cyan coupler, 2-(heptafluorobutyramido)-5-[2'-(2'',4''-di-t-aminophenoxy)butyramido]phenol in a mixture of 100 ml of tricresyl phosphate and 100 ml of ethyl acetate, mixing the solution with 1 kg of an aqueous 10% gelatin solution with stirring at high speed, mixing the mixture thus obtained with 1 kg of a red-sensitive silver iodobromide emulsion (containing 70 g of silver and 60 g of gelatin, 6 mol% in iodine content), and coating the resulting mixture at a dry thickness of 1μ (silver coverage of 0.5 g/m$^2$).

Fourth Layer

High Speed Red-Sensitive Emulsion Layer

The layer was formed by dissolving 100 g of a cyan coupler, 2-(heptafluorobutyramido)-5-[2'-(2'',4''-di-t-aminophenoxy)butyramido]phenol in a mixture of 100 ml of tricresyl phosphate and 100 ml of ethyl acetate, mixing the solution with 1 kg of an aqueous 10% gelatin solution with stirring at high speed, mixing 1,000 g of the emulsion thus obtained with 1 kg of a red-sensitive silver iodobromide emulsion (containing 70 g of silver and 60 g of gelatin, 6 mol% in iodine content), and coating the resulting mixture at a dry thickness of 2.5μ (silver coverage of 0.8 g/m$^2$).

Fifth Layer

Interlayer

The layer was formed by dissolving 2,5-di-t-octylhydroquinone in a mixture of 100 ml of dibutyl phthalate and 100 ml of ethyl acetate, mixing the solution with 1 kg of an aqueous 10% gelatin solution with stirring at high speed, mixing 1 kg of the emulsion thus obtained with 1 kg of an aqueous 10% gelatin solution, and coating the resulting mixture at a dry thickness of 1μ.

Sixth Layer

Low Speed Green-Sensitive Emulsion Layer

The layer was formed by forming an emulsion in the same manner as the case of forming the emulsion for Third Layer using a magenta coupler, 1-(2,4,6-trichlorophenyl)-3-[3-(2,4-di-t-amylphenoxyacetamido)-benzamido]-5-pyrazolone in place of the cyan coupler, mixing 300 g of the emulsion thus obtained with 1 kg of a green-sensitive silver iodobromide emulsion (containing 70 g of silver and 60 g of gelatin, 7 mol% in iodine content), and coating the resulting mixture at a dry thickness of 1.3μ (silver coverage of 1.1 g/m$^2$).

Seventh Layer

High Speed Green-Sensitive Emulsion Layer

The layer was formed by forming an emulsion in the same manner as the case of forming the emulsion for Fourth Layer using a magenta coupler, 1-(2,4,6-trichlorophenyl)-3-[3-(2,4-di-t-amylphenoxyacetamido)-benzamido]-5-pyrazolone in place of the cyan coupler, mixing 1,000 g of the emulsion thus obtained with 1 kg of a green-sensitive silver iodobromide emulsion (containing 70 g of silver and 60 g of gelatin, 6 mol% in iodine content), and coating the resulting mixture at a dry thickness of 3.5μ (silver coverage of 1.1 g/m$^2$).

Eighth Layer

Yellow Filter Layer

The layer was formed by coating an emulsion containing yellow colloid silver at a dry thickness of 1μ.

Ninth Layer

Low Speed Blue-Sensitive Emulsion Layer

The layer was formed by forming an emulsion in the same manner as the case of forming the emulsion for Third Layer using a yellow coupler, α-(pivaloyl)-α-(1-benzyl-5-ethoxy-3-hydantoinyl)-2-chloro-5-dodecyloxycarbonylacetanilide in place of the cyan coupler, mixing 1,000 g of the emulsion thus obtained with 1 kg of a blue-sensitive silver iodobromide emulsion (containing 70 g of silver and 60 g of gelatin, 7 mol% in iodine content), and coating the resulting mixture at a dry thickness of 1.5μ (silver coverage of 0.4 g/m$^2$).

Tenth Layer

High Speed Blue-Sensitive Emulsion Layer

The layer was formed by forming an emulsion in the same manner as the case of forming the emulsion for Fourth Layer using a yellow coupler, α-(pivaloyl)-α-(1-benzyl-5-ethoxy-3-hydantoinyl)-2-chloro-5-dodecyloxycarbonylacetanilide in place of the cyan coupler, mixing 1,000 g of the emulsion thus obtained with 1 kg of a blue-sensitive iodobromide emulsion (containing 70 g of silver and 60 g of gelatin, 6 mol% in iodine content), and coating the resulting mixture at a dry thickness of 3μ (silver coverage of 0.8 g/m$^2$).

Eleventh Layer

Second Protective Layer

The layer was formed by mixing 1 kg of the emulsion having the same composition as used for Second Layer with 1 kg of an aqueous 10% gelatin solution and coating the mixture at a dry thickness of 2μ.

Twelfth Layer

First Protective Layer

The layer was formed by coating an aqueous 10% gelatin solution containing a surface-fogged fine grain silver halide emulsion (grain size: 0.06μ, 1 mol% silver iodobromide emulsion) at a silver coverage of 0.1 g/m$^2$ and a dry thickness of 0.8μ.

The sample thus prepared was imagewise exposed through a sensitometric wedge to white light of a light source of 4,800° K. under an exposure surface illuminance of 500 lux and thus subjected to the following reversal sensitization processing to provide color images.

The processing steps used in this example were as follows.

| Sensitization Processing Step | Time (min) | Temperature |
|---|---|---|
| Black-and-White Development | 10 | 38° C. |
| Wash | 2 | " |
| Reversal | 2 | " |
| Color Development | 6 | " |
| Control | 2 | " |
| Bleach | 6 | " |
| Fix | 4 | " |
| Wash | 4 | " |
| Stabilization | 1 | Normal Temperature |

The compositions of the processing liquids used in the above steps were as follows.

| Black-and-White Developer: | |
|---|---|
| Water | 700 ml |
| Nitrilo-N,N,N—trimethylenephosphonic Acid.6 Na Salt | 3 g |
| Sodium Sulfite | 20 g |
| Hydroquinone Monosulfonate | 30 g |
| Sodium Carbonate (monohydrate) | 30 g |
| 1-Phenyl-4-methyl-4-hydroxymethyl-3-pyrazolidone | 2 g |
| Potassium Bromide | 2.5 g |
| Potasium Thiocyanate | 1.2 g |
| Potassium Iodide (0.1% solution) | 2 ml |
| Water to make | 1,000 ml (pH 10.1) |
| Reversal Liquid: | |
| Water | 700 ml |
| Nitrilo-N,N,N—trimethylenephosphonic Acid.6 Na Salt | 3 g |
| Stannous Chloride (dihydrate) | 1 g |
| p-Aminophenol | 0.1 g |
| Sodium Hydroxide | 8 g |
| Glacial Acetic Acid | 15 ml |
| Water to make | 1,000 ml |
| Color Developer: | |
| Water | 700 ml |
| Nitrilo-N,N,N—trimethylenephosphonic Acid.6 Na Salt | 3 g |
| Sodium Sulfite | 7 g |
| Sodium Tertiary Phosphate (12 $H_2O$) | 36 g |
| Potassium Bromide | 1 g |
| Potassium Iodide (0.1% solution) | 90 ml |
| Sodium Hydroxide | 3 g |
| Citrazinic Acid | 1.5 g |
| N—Ethyl-N—(β-methanesulfonamidoethyl)-3-methyll-4-aminoaniline Sulfate | 11 g |
| Ethylenediamine | 3 g |
| Water to make | 1,000 ml |
| Control Liquid: | |
| Water | 700 ml |
| Sodium Sulfite | 12 g |
| Ethylenediaminetetraacetic Acid | 8 g |

-continued

| Black-and-White Developer: | |
|---|---|
| Sodium Salt (dihydrate) | |
| Thioglycerol | 0.4 ml |
| Glacial Acetic Acid | 3 ml |
| Water to make | 1,000 ml |
| Bleach Liquid: | |
| Water | 800 g |
| Ethylenediaminetetraacetic Acid Sodium Salt (dihydrate) | 2.0 g |
| Ethylenediaminediaminetetraacetic Acid Iron (III) Ammonium (dihydrate) | 120.0 g |
| Potassium Bromide | 100.0 g |
| Water to make | 1,000 ml |
| Fix Liquid: | |
| Water | 800 ml |
| Ammonium Thiosulfate | 80.0 g |
| Sodium Sulfite | 5.0 g |
| Sodium Hydrogensulfite | 5.0 g |
| Water to make | 1,000 ml |
| Stabilization Liquid: | |
| Water | 800 ml |
| Formalin (37 wt %) | 5.0 ml |
| Fuji Driwel (trade name, made by Fuji Photo Film Co., Ltd.) | 5.0 ml |
| Water to make | 1,000 ml |

The sample thus processed was measured about the cyan image density using a red filter and Dmax (maximum density) and $\gamma$ (gradation) were obtained (Process A).

In this case when the density of the point of 0.5 exposure amount less than the sensitivity point (D=1.00) on the characteristic curve by $-\log E$ is defined as Ds, the gradation ($\gamma$) is determined by the following equation:

$$\gamma=(Ds-1.0)/0.5$$

Then, the compound shown in Table 1 was added to the above described black-and-white developer and the reversal color processing as above was performed using the black-and-white developer. In this case, however, as the developing time for the black-and-white development, the developing time capable of obtaining the same sensitivity as the case of not adding the compound shown in Table 1 to the black-and-white developer was selected. Also, Dmax and $\gamma$ were also obtained by the same manner as above (Process B).

Then, the differences between the case of employing Process A and the case of employing Process B are shown in Table 1.

Thus, the existence of the effect of preventing the occurrence of fog at the black-and-white development of the lower layers, i.e., the red-sensitive emulsion layers without reducing the sensitivity at the black-and-white development was evaluated by $\Delta$ Dmax and $\Delta\gamma$. The existence of the effect means that the two factors:

(1) the gradation does not become high, and (2) the maximum cyan density is high are satisfied on the characteristic curve.

This is more practically shown in the FIGURE, in which the abscissa shows the logarithm of the exposure amount and the ordinate shows the cyan image density.

To the standard characteristic curve a (i.e., the characteristic curve obtained by employing Process A), the characteristic curves obtained by employing Process B which was performed using a black-and-white developer containing each of various compounds as, for example, shown in Table 1 below are considered to be shown by curves b, c and d.

Curve b shows the improvement of Dmax and does not show the reduction of sensitivity (the sensitivity point D=1.00). That is, curve b satisfies the above described two factors (1) and (2).

Curve c shows the improvement of Dmax but does not satisfy the above described condition (1) although it satisfies the condition (2) since the gradation becomes hard tone.

Curve d does not slow the improvement of Dmax and shows a soft tone of gradation. That is, it satisfies condition (1) but does not satisfy condition (2).

Thus, the existence of the effect of preventing the formation of fog without reducing sensitivity means that the $\Delta$Dmax value is positive and the $\Delta\gamma$ value does not become negative.

TABLE 1

| Sample No. | Compound | Addition Amount (mol/l) | Red-Sensitive Layer Δ Dmax | Δ γ |
|---|---|---|---|---|
| 1 | I-a-1 | $0.65 \times 10^{-5}$ | 0.13 | 0 |
| 2 | I-a-2 | " | 0.15 | 0 |
| 3 | I-a-5 | " | 0.14 | 0 |
| 4 | I-a-13 | " | 0.09 | 0 |
| 5 | I-b-1 | " | 0.22 | 0 |
| 6 | I-b-5 | " | 0.15 | 0 |
| 7 | A | " | 0 | −0.16 |
| 8 | B | " | 0 | 0 |
| 9 | C | " | 0 | 0 |
| 10 | D | " | 0 | −0.07 |
| 11 | E | " | 0.05 | −0.15 |
| 12 | F | " | 0.09 | −0.10 |
| 13 | G | " | 0.06 | 0 |
| 14 | H | " | 0.07 | −0.05 |

Sample Nos. 1 to 6 are samples of this invention and
Sample Nos. 7 to 14 are comparison examples.
Δ Dmax = (Dmax value at Process B) − (Dmax value at Process A)
Δ γ = (γ value at Process A) − (γ value at Process B)

Also, Comparison Compounds A to H shown in Table 1 are as follows.

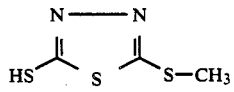

Compound A

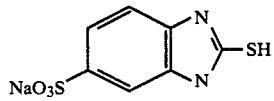

Compound B

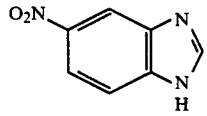

Compound C

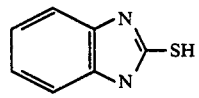

Compound D

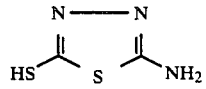

Compound E

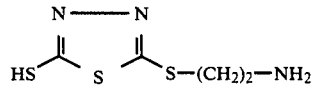

Compound F

-continued

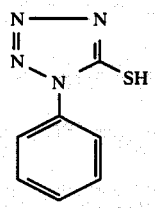

Compound G

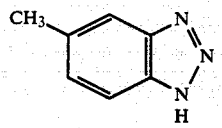

Compound H

From the results shown in Table 1, it can be seen that in the case of using the comparison compounds (Sample Nos. 7 to 14), an antifogging effect for the red-sensitive emulsion layer may be obtained but tye sensitivity is reduced, or the antifogging effect itself is not obtained. On the other hand, in the case of using the compounds of this invention shown by general formula (I-a) or (I-b) described above, the formation of fog in the red-sensitive emulsion layer can be greatly inhibited without being accompanied by an increase of the hardness of the contrast, i.e., without being accompanied by a reduction in sensitivity.

EXAMPLE 2

Samples were prepared by following the same procedures as in Example 1 except that each of the compounds of this invention or the comparison compounds shown in Table 2 was added to the black-and-white developer having the same composition as used in Example 1 together with the development accelerator shown below and the development was performed under the conditions shown in Table 2. The antifogging effect for the lowermost layer of each sample thus prepared was evaluated and the results thus obtained are shown in Table 2 below.

TABLE 2

| Sample No. | Addition Compound | Addition Amount (mol/l) | Addition Amount of Development Accelerator (mol/l) | Red-Sensitive Emulsion Layer Δ Dmax | Red-Sensitive Emulsion Layer Δ γ | First Development Time (Process B) |
|---|---|---|---|---|---|---|
| 21 | I-a-(2) | $0.64 \times 10^{-5}$ | $0.27 \times 10^{-3}$ | 0.11 | −0.15 | 10 min |
| 22 | I-a-(5) | " | " | 0.09 | −0.07 | " |
| 23 | I-a-(10) | " | " | 0.08 | −0.09 | " |
| 24 | I-a-(13) | " | " | 0.11 | −0.11 | " |
| 25 | A | $0.61 \times 10^{-5}$ | $0.27 \times 10^{-3}$ | −0.04 | −0.08 | " |
| 26 | B | $0.40 \times 10^{-5}$ | " | −0.34 | −0.78 | " |
| 27 | C | $0.15 \times 10^{-3}$ | $0.82 \times 10^{-3}$ | 0.15 | 0.29 | " |
| 28 | D | $0.66 \times 10^{-5}$ | $0.27 \times 10^{-3}$ | 0.09 | 0.09 | " |

Sample Nos. 21 to 24: Samples of this invention.
Sample Nos. 25 to 28: Comparison samples.

The comparison compounds used in the example were the same as those used in Example 1. The development accelerator used was $HOCH_2CH_2—S—CH_2CH_2—S—CH_2CH_2OH$.

In addition, the addition amounts of the compound of this invention, the comparison compound, and the development accelerator in Table 2 were selected so that the same sensitivity as that obtained by performing Process A (in this case, however, the black-and-white development was performed for 12 minutes at 38° C.) in Example 1 and also the most preferred antifogging effect was obtained.

From the results shown in Table 2, it can be seen that in the case of employing the black-and-white developer containing the compound of this invention, the Dmax of the red-sensitive emulsion layer which is the lowermost layer is high, the gradation becomes slightly soft, and a sufficient antifogging effect is obtained, while in the case of employing the black-and-white developer containing the Comparison Compound A or B, the Dmax is low and an antifogging effect is not obtained and in the case of employing the black-and-white developer containing Comparison Compound C or D, the Dmax may be high but the gradation becomes hard and hence the antifogging effect is not obtained. Thus, in the case of obtaining a high sensitivity in a short period of time using a development accelerator, the compound of this invention can sufficiently exhibit the effect of preventing the formation of development fog in the lowermost layer of a color photographic material.

While the invention has been described in detail and with reference to specific embodiments thereof, it will be apparent to one skilled in the art that various changes and modifications can be made therein without departing from the spirit and scope thereof.

What is claimed is:

1. A method for processing an imagewise exposed silver halide color reversal photgraphic material which comprises processing the color reversal photographic material with a black-and-white developer containing at least one compound represented by the following general formula (I-a) or (I-b):

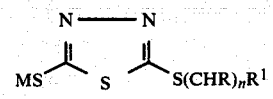

(I-a)

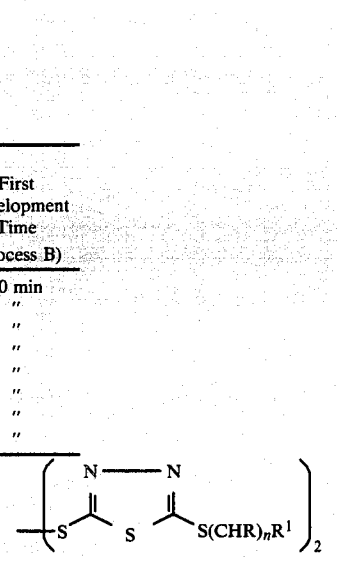

(I-b)

wherein M represents a hydrogen atom, an alkali metal, or an ammonium ion; R represents a hydrogen atom, an unsubstituted or substituted alkyl group, a hydroxy group, $—SO_3M^1$, or $—COOM^1$; $R^1$ represents $—SO_3M^1$ or $—COOM^1$, wherein $M^1$ represents a hydrogen atom, an alkali metal, or an ammonium ion; and n represents an integer of 1 to 6; and when n is 2 to 6, each of said Rs may be the same or different, wherein the black-and-white developer further contains a development accelerator represented by the general formula (II):

$$R_2(S—R_1)_dS—R_2 \quad (II)$$

wherein $R_1$ represents an alkylene group having 1 to 10 carbon atoms; said alkylene group may have an ether bond; $R_2$ represents a substituted or unsubstituted alkyl group having 1 to 10 carbon atoms; said alkyl group may have an ether bond, or an ester bond; and d represents an integer of 0 to 3, wherein the compound of general formula (I-a) or (I-b) is employed in an amount of from $5\times10^{-7}$ mol to $5\times10^{-2}$ mol per liter of black-and-white developer, the compound of general formula (II) is employed in an amount of from $5\times10^{-6}$ to $5\times10^{-1}$ mole per mol of the black-and-white developer and wherein the black-and-white developer further contains a compound functioning as a silver halide solvent.

2. The method as claimed in claim 1, wherein the amount of the compound shown by general formula (I-a) or (I-b) is $5\times10^{-7}$ mol to $5\times10^{-2}$ mol per liter of the black-and-white developer.

3. The method as claimed in claim 1, wherein said alkyl group has 1 to 6 carbon atoms.

4. The method as claimed in claim 1, wherein said alkali metal is selected from the group consisting of sodium, potassium and lithium.

5. The method as claimed in claim 1, wherein the substituent for R is selected from the group consisting of a sulfonic acid group, a carboxylic acid group, and a hydroxy group.

6. The method as claimed in claim 2, wherein the amount of the compound shown by general formula (I-a) or (I-b) is $1\times10^{-6}$ mol to $2\times10^{-3}$ mol per liter of the black-and-white developer.

7. The method as claimed in claim 6, wherein the amount of the compound shown by general formula (I-a) or (I-b) is $1\times10^{-6}$ mol to $1\times10^{-4}$ mol per liter of the black-and-white developer.

8. The method as claimed in claim 4, wherein said compound of general formula (II) is employed in an amount of from $5\times10^{-6}$ to $5\times10^{-1}$ mol per mol of the black-and-white developer.

9. The method as claimed in claim 1, wherein said black-and-white developer further contains a compound functioning as a silver halide solvent.

10. The method as claimed in claim 9, wherein the silver halide solvent is selected from the group consisting of a sulfite, KSCN, NaSCN, $K_2SO_3$, $Na_2SO_3$, $K_2S_2O_5$, $Na_2S_2O_5$, $K_2S_2O_3$ and $Na_2S_2O_3$.

11. The method as claimed in claim 1, wherein the processing temperature is from 18° to 60° C.

12. The method as claimed in claim 1, wherein the processing temperature is from 25° C. to 42° C.

13. The method as claimed in claim 1, wherein the compound of general formula (I-a) is used.

14. The method as claimed in claim 1, wherein the compound of general formula (I-b) is used.

15. The method as claimed in claim 1, wherein R represents said hydrogen atom.

16. The method as claimed in claim 1, wherein R represents said unsubstituted or substituted alkyl group.

* * * * *